US008382514B1

(12) United States Patent
Shapson et al.

(10) Patent No.: US 8,382,514 B1
(45) Date of Patent: Feb. 26, 2013

(54) WALL PLATE/COVER HOUSING ASSEMBLY

(75) Inventors: Jay F. Shapson, Millstone Township, NJ (US); Brian J. Shapson, Millstone Township, NJ (US); Matthew M. Shapson, Robbinsville, NJ (US)

(73) Assignee: Extreme Broadband Engineering, LLC, Millstone Township, NJ (US)

( * ) Notice: Subject to any disclaimer, the term of this patent is extended or adjusted under 35 U.S.C. 154(b) by 0 days.

(21) Appl. No.: 13/593,780

(22) Filed: Aug. 24, 2012

(51) Int. Cl.
*H01R 13/66* (2006.01)

(52) U.S. Cl. ..... 439/528; 439/536

(58) Field of Classification Search ..... 439/528, 439/536, 538, 373, 532
See application file for complete search history.

(56) References Cited

U.S. PATENT DOCUMENTS

| | | | | |
|---|---|---|---|---|
| 4,043,629 | A * | 8/1977 | Brannen | 439/564 |
| 5,356,311 | A * | 10/1994 | Liu | 439/536 |
| 5,651,696 | A | 7/1997 | Jennison | 439/536 |
| 5,882,215 | A | 3/1999 | Burns | 439/142 |
| 6,793,524 | B2 * | 9/2004 | Clark et al. | 439/536 |
| 6,988,914 | B2 | 1/2006 | Pepe et al. | 439/638 |
| 7,038,561 | B2 * | 5/2006 | Esty | 335/18 |
| 7,163,418 | B2 * | 1/2007 | Macor | 439/536 |
| 7,404,738 | B2 | 7/2008 | Montena | 439/579 |
| 7,674,129 | B1 * | 3/2010 | Liu | 439/532 |
| 7,873,062 | B2 | 1/2011 | Binder | 370/419 |
| 2006/0099857 | A1 | 5/2006 | Ames | 439/638 |
| 2007/0275595 | A1 | 11/2007 | Hazani et al. | 439/536 |
| 2011/0097939 | A1 | 4/2011 | Binder | 439/638 |
| 2012/0028506 | A1 | 2/2012 | Binder | 439/638 |

* cited by examiner

*Primary Examiner* — Gary F. Paumen
(74) *Attorney, Agent, or Firm* — Watov & Kipnes, P.C.; Kennth Watox

(57) ABSTRACT

A faceplate is configured for covering a wall opening providing access to electrical signal cables. The faceplate itself has an opening leading into the wall opening, and a pair of mounting holes above and below the opening. A cover housing is formed to secure an electrical device within a cavity thereof. The faceplate and cover housing are adapted to provide for the latter being removably secured to the front of the faceplate, after the electrical device is connected to at least one of the signal cables. The cover housing is configured to permit a user to connect a signal cable to the electrical device, and signal cables from the wall opening thereto.

23 Claims, 18 Drawing Sheets

WALL PLATE/COVER HOUSING ASSEMBLY

FIELD OF THE INVENTION

The present invention relates generally to wall plates configured to provide an aesthetic appearing cover for wall openings and provide access to electrical wires such as coaxial cables for feeding electrical signals including internet signals, radio signals, video signals, and so forth, to a room for connection thereto by a user, whereby one or more coaxial cables, for example, may be accessible via the wall opening.

BACKGROUND OF THE INVENTION

Typically, Ethernet cables, and coaxial cables are wired into a building for feeding internet signals, television signals, radio signals, and so forth, to various rooms within the building. Coaxially cables typically are accessed in each room via holes in the wall, whereby the cables may have connectors connected to their free ends, for connection to mating connectors of various devices such as splitters, amplifiers, digital video recorders, and so forth. In the prior art various wall plates have been developed to provide an aesthetic appearance and cover over the hole in the wall, while permitting the coaxial cable or Ethernet cables, for example, to be electrically connected to connectors installed on the wall plate, whereby a user can readily couple a connector from the end of a coaxial cable to the appropriate wall plate connector, for connection at the other end of the cable to a device such as a computer, television system, and other such devices, for example. In one example of a typical installation for feeding coaxial cable carried signals into a room, a device known as a splitter is employed, whereby an input port of the splitter is connected to a feed cable provided at the hole in the wall for feeding cable television/internet signals into the splitter device. The splitter is designed to typically split off one portion of the signals being provided and feed them to a first output port to permit a user to connect their coaxial cable input line thereto for accessing the tapped off signals. The splitter also taps off the remaining and major portion of the signals and feeds them to a second output port for connection to another coaxial cable provided in the wall opening to permit signals from the second output port to be fed to other rooms in the building. In many prior installations a splitter device may be installed within the wall opening, whereby the input port is connected to the coaxial cable feeding an incoming signal, such as an RF signal, and a first output port of the splitter is connected to the end of another coaxial cable in the wall, as previously mentioned, for transferring tapped off outgoing signals into the second cable for feeding these signals to other rooms in the building. The second output port of the splitter is configured for protruding through a hole in a wall plate for permitting user access thereto for connecting to tapped off signals from the feed cable as previously described. It is known in the prior art to configure a splitter in a manner permitting the splitter to be mounted to the back of the wall plate for connection to the ends of the coaxial cables within the wall opening, whereafter the wall plate is secured to the wall to cover the opening, with the user output port protruding therefrom. A problem with this type of prior wall plate/splitter installation is that in order to obtain access to the splitter device itself, or to replace the splitter should it become defective, an installer must remove the wall plate in order to do so. Accordingly, there is a need in the art to both provide an aesthetic wall plate system while facilitating easy removal and connection of a splitter device, for example, to the signal feed and signal return cables within the wall opening.

SUMMARY OF THE INVENTION

In one embodiment of the invention, a two piece wall plate system is provided that includes a faceplate for securement to the wall over the opening in the wall. The faceplate includes a large enough opening for permitting easy access to the cables within the wall opening. A cover housing is provided with attachment means for interacting with mating attachment means on the faceplate for permitting the cover housing to be easily secured to or removed from the front of the faceplate. The cover housing is configured for permitting in one embodiment a two-way splitter to be secured within a cavity accessible from the back of the cover housing, whereby the splitter is configured to provide one output port protruding therefrom for installation through a hole in the cover housing to permit a user to connect thereto for receiving various signals as previously described. The splitter is further configured to have the return signal output port and input port thereof readily accessible at the back of the cover housing for connection to the coaxial cables within the wall opening, as previously described. In another embodiment of the invention, the cover housing can be otherwise configured for providing an Ethernet cable connector and/or coaxial cable F-81 connector protruding therefrom for access by a user.

BRIEF DESCRIPTION OF THE DRAWINGS

Various embodiments of the present invention are described below with reference to the drawings, in which like elements are indicated by the same reference designation, wherein.

DETAILED DESCRIPTION OF THE INVENTION

Figure 1:
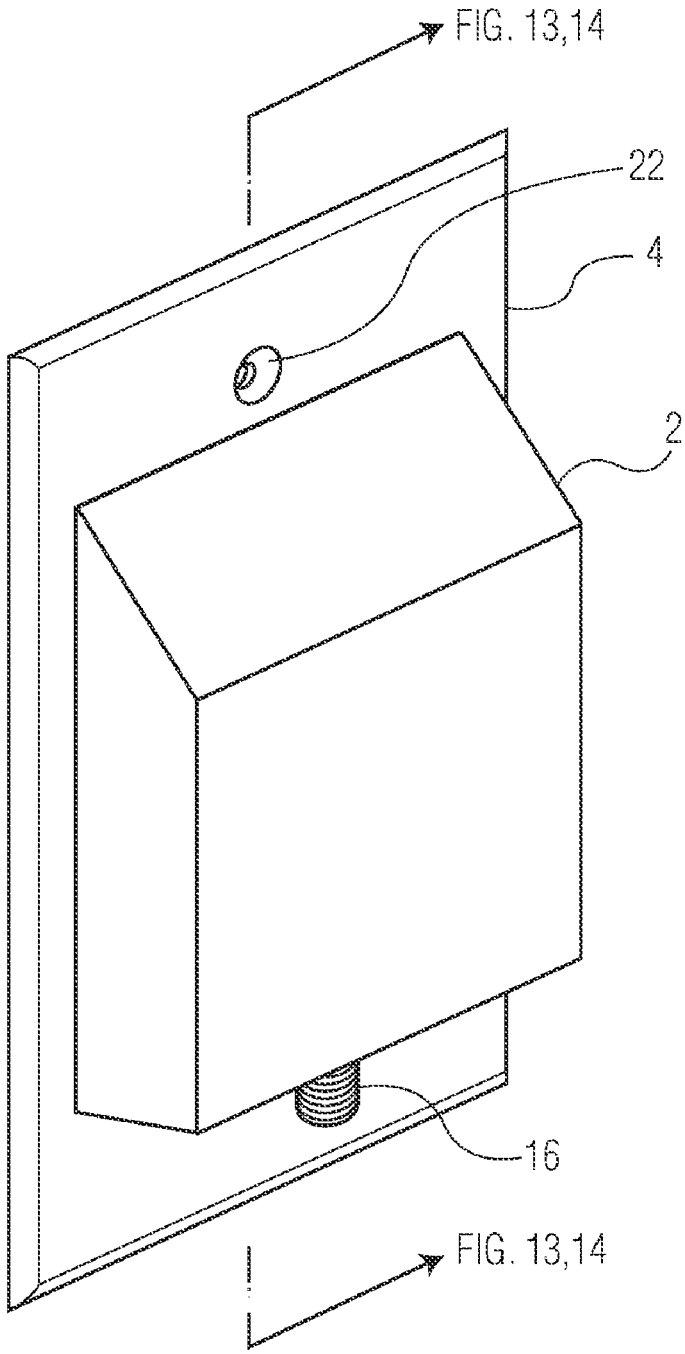
FIG. 1 shows a pictorial view for one embodiment of the invention.
Figure 2:
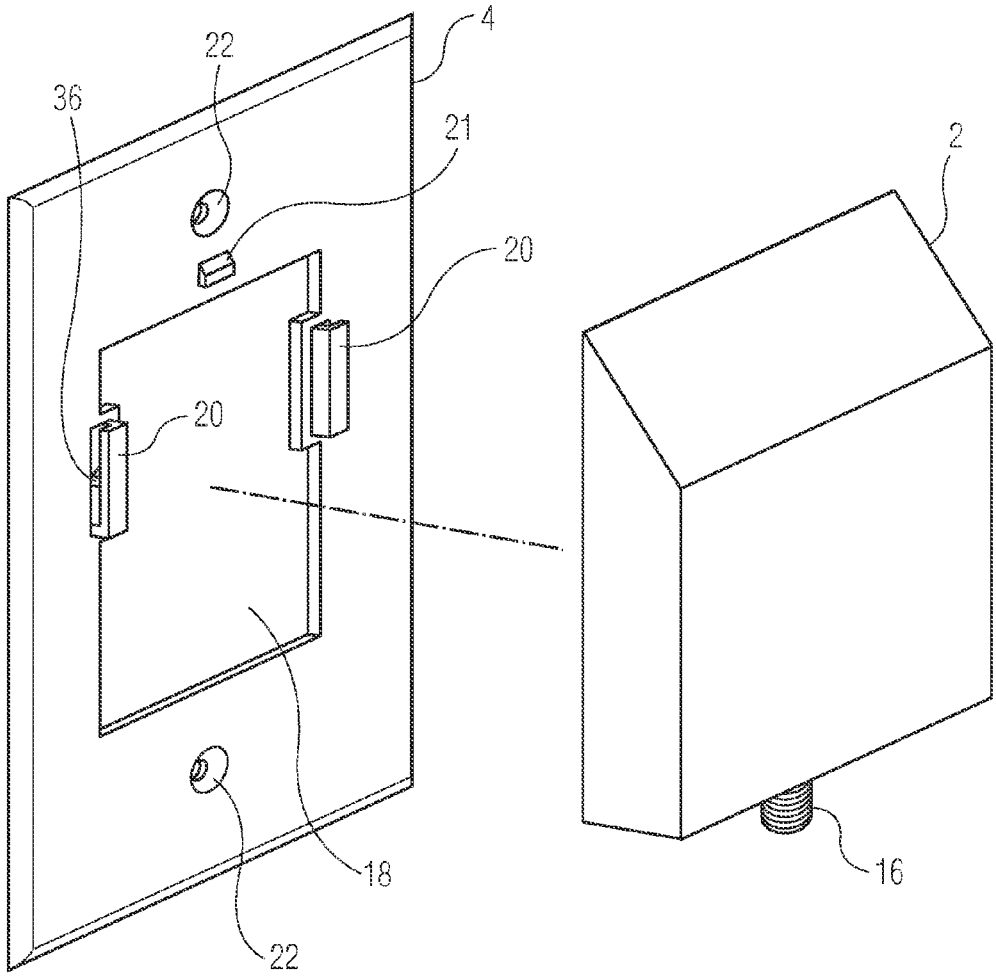
FIG. 2 shows an exploded partial assembly view of the embodiment of the invention of FIG. 1.
Figure 13:
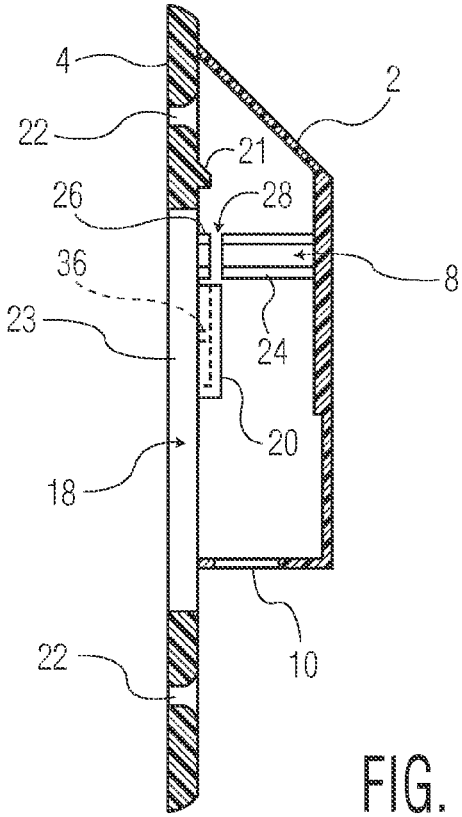
FIG. 13 shows a cross-sectional view taken along 13-13 of FIG. 1, with the splitter removed, with the cover housing positioned for being slid downward upon the faceplate for locking the two together.
Figure 14:
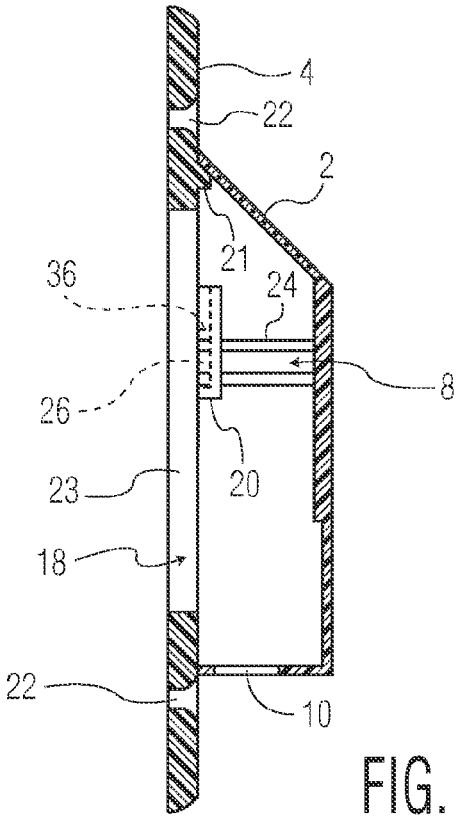
FIG. 14 is a cross-sectional view taken along 14-14 of FIG. 1, with the splitter removed, for further showing the cover housing having been slid downward upon the front of the faceplate for locking the two together.
Figure 15:
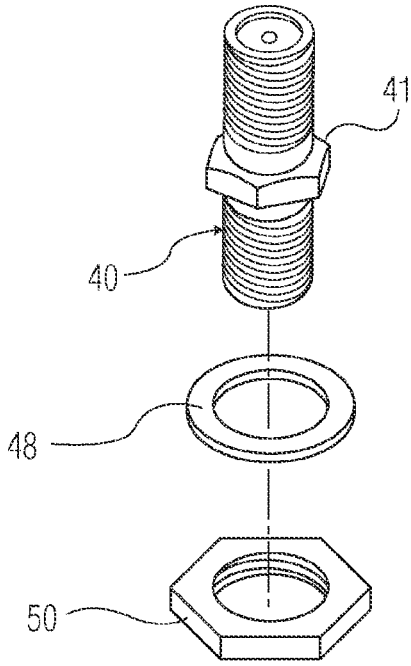
FIG. 15 is a pictorial view of an F-81 connector for another embodiment of the invention.
Figure 21:
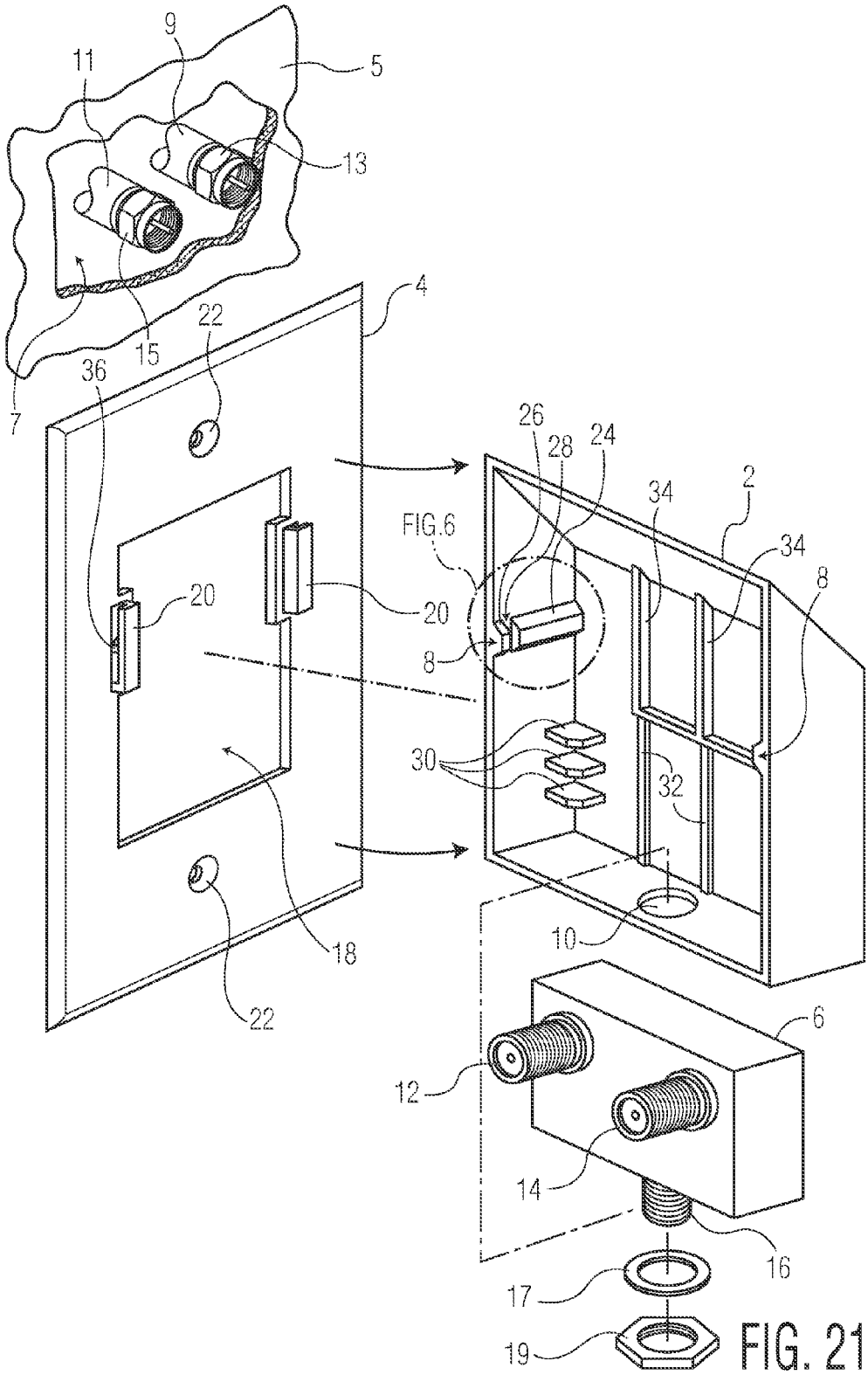
FIG. 21 shows an exploded assembly view for another embodiment of the invention.

With reference to FIGS. 1 and 2 through 20, one embodiment of the invention will now be described in detail. As shown in FIG. 1, and in the exploded assembly views of FIGS. 2 and 3, faceplate 4 is typically secured over a coaxial cable access hole 7 in a wall 5 via screws (not shown) inserted through holes 22 in the faceplate 4 and screwed into the wall 5 surrounding the wall hole 7. In this example, a two-way splitter 6 is secured within cover housing 2 by pushing splitter 6 into the cavity of the cover housing 2 and positioning a user output port 16 from splitter 6 to protrude from a port hole 10 of cover housing 2. Output port 16 is secured to cover housing 2 through use of typically a washer 17 and nut 19, as shown. In this example, a signal feed-in coaxial cable 9 is connected via its associated male F-type connector 13 to a female F-type input port 12. A tapped-off feedback signal provided at output port 14 is connected to a feedback cable 11 located in wall hole 7 via an associated F-type male coaxial cable connector 15 that mounts onto output port 14. Note that typically with faceplate 4 mounted over hole 7, a feed-in cable 9 with associated connector 13, and feedback cable 11 with associated connector 15, are each accessed through the cable access hole 18 in faceplate 4 for connection to the 2-way splitter 6 as previously indicated. After this connection is made, the cover housing 2 is positioned as shown in FIGS. 2, 3, 12, 13, and 14, on the front surface of faceplate 4, and slid downward to cause the attachment slots 8 of cover housing 2 to engage in mounting cups 20. The cover housing 2 downward positioning is limited by a protruding stop tab 21 as shown in FIGS. 13 and 14 (also see FIGS. 3, 11, and 18). Note that FIG. 13 shows a cover housing 2 first positioned on faceplate 4 for installation thereon, and FIG. 14 shows positioning for the cover plate 2 on faceplate 4 after the cover plate 2 ahs been slid downward to secure it to faceplate 4, as previously indicated. Reference is made to the pictorial views of FIGS. 1, 8, 9, and 12 showing various views, respectively, of the cover housing 2 with splitter 6 mounted therein, as installed on the front of faceplate 4. Note, also that FIG. 1 is a pictorial view of the cover housing 2 containing splitter 6, as assembled upon a faceplate 4, looking toward the front thereof. Further note, as shown in FIG. 21, that the stop tab 21 is optional, for the reason that a stop function is also provided by the interaction between the attachment slots 8 of cover housing 2 and mounting clips 20, as described below.

Figure 3:
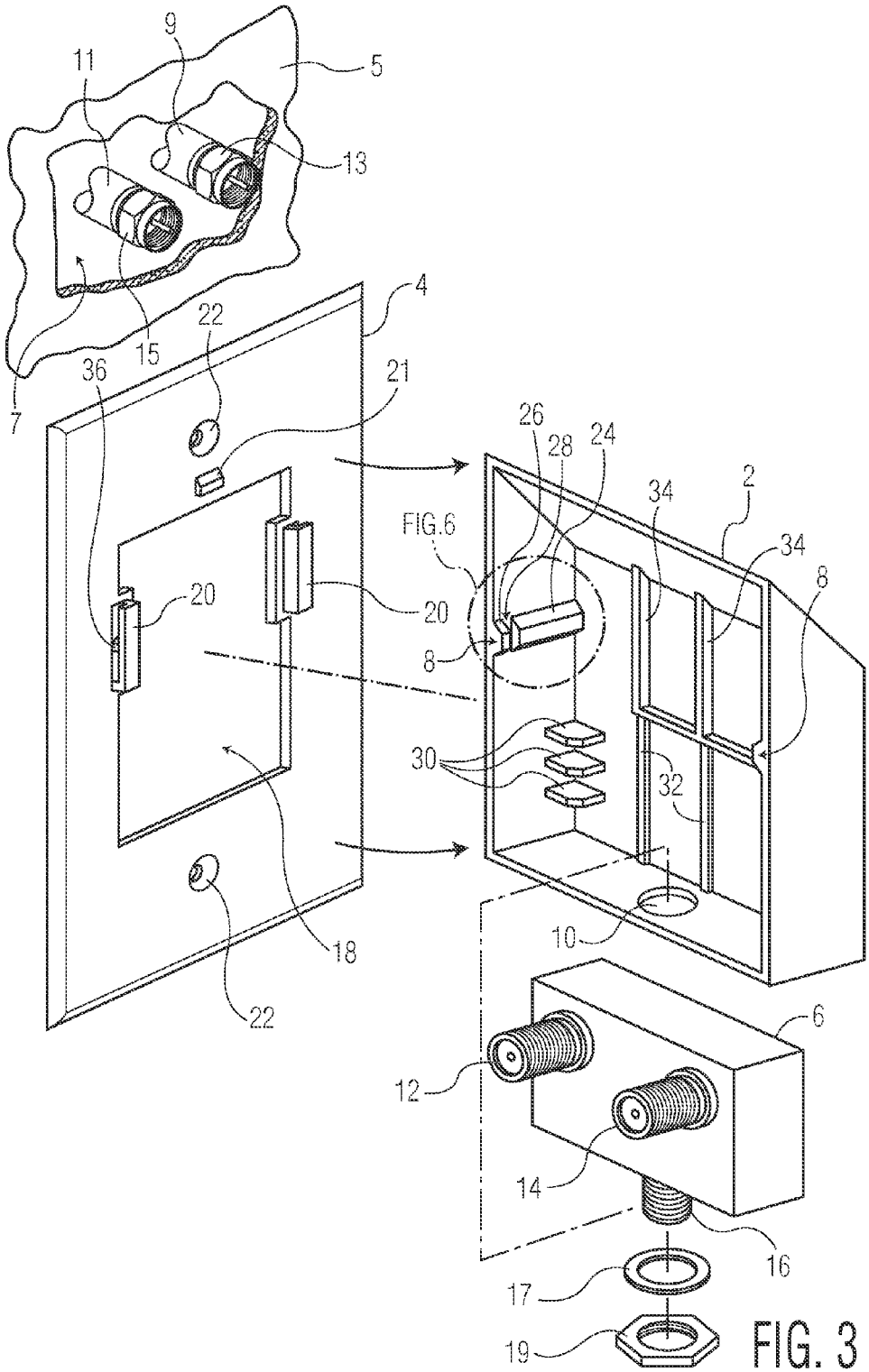
FIG. 3 shows an exploded assembly view for an embodiment of the invention.
Figure 4:
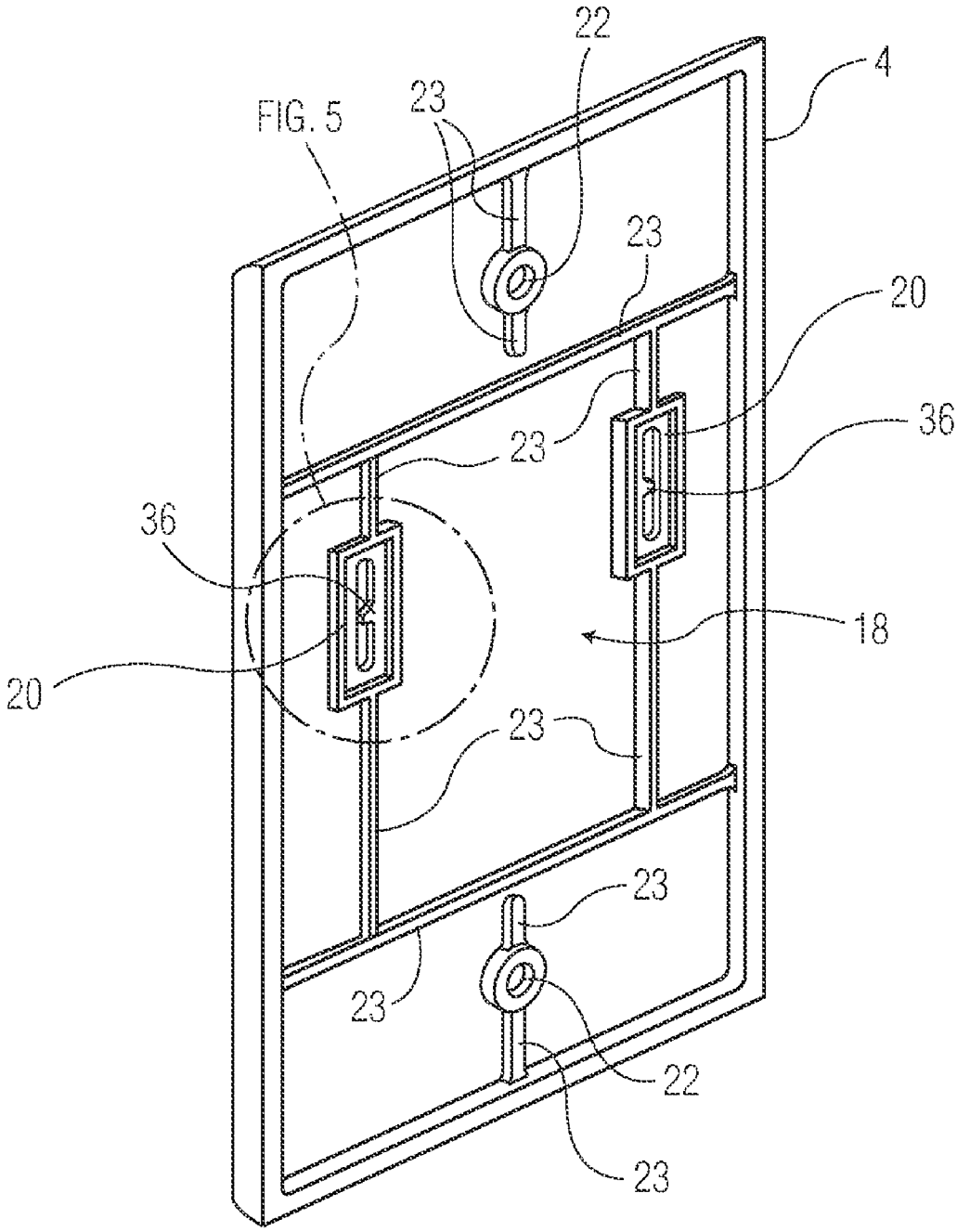
FIG. 4 shows pictorial views looking toward the back portions of a faceplate for an embodiment of the invention.
Figure 5:
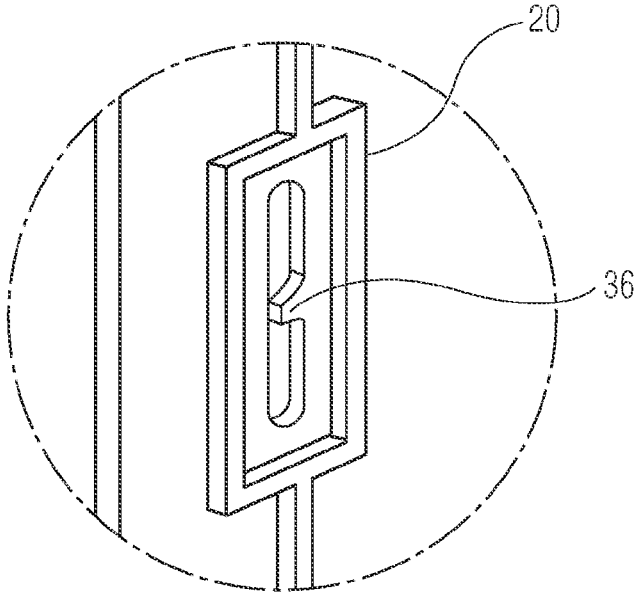
FIG. 5 shows a detailed view of the back portion of a mounting dip of the wall plate for an embodiment of the invention relative to FIG. 4.
Figure 6:
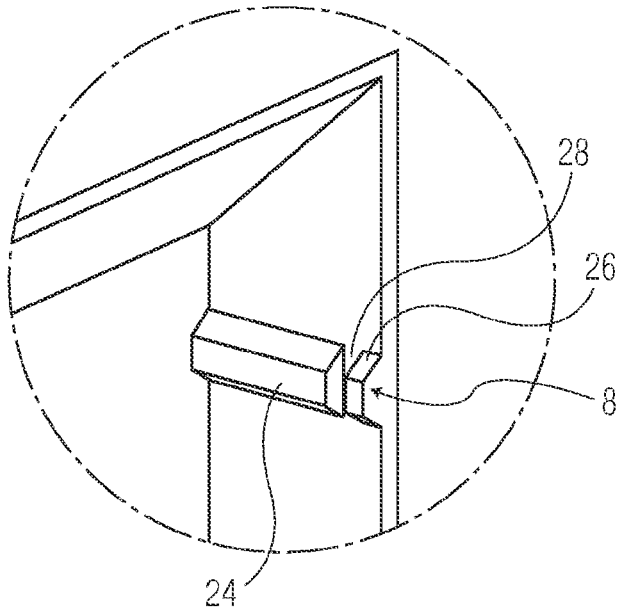
FIG. 6 shows a detailed view of an attachment slot located on an inside sidewall of the cover housing relative to FIG. 3.
Figure 7:
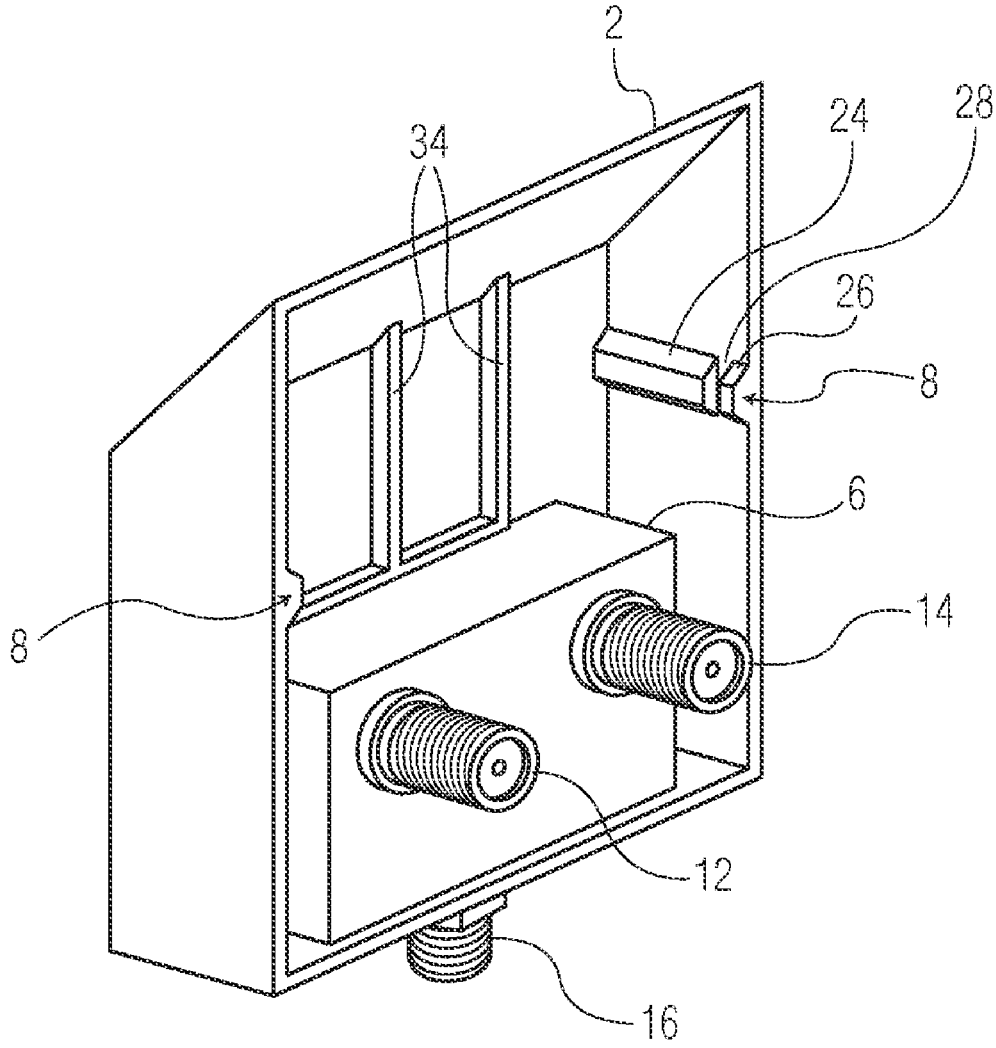
FIG. 7 shows a pictorial view of the back of the cover housing with a splitter installed therein for an embodiment of the invention.
Figure 8:
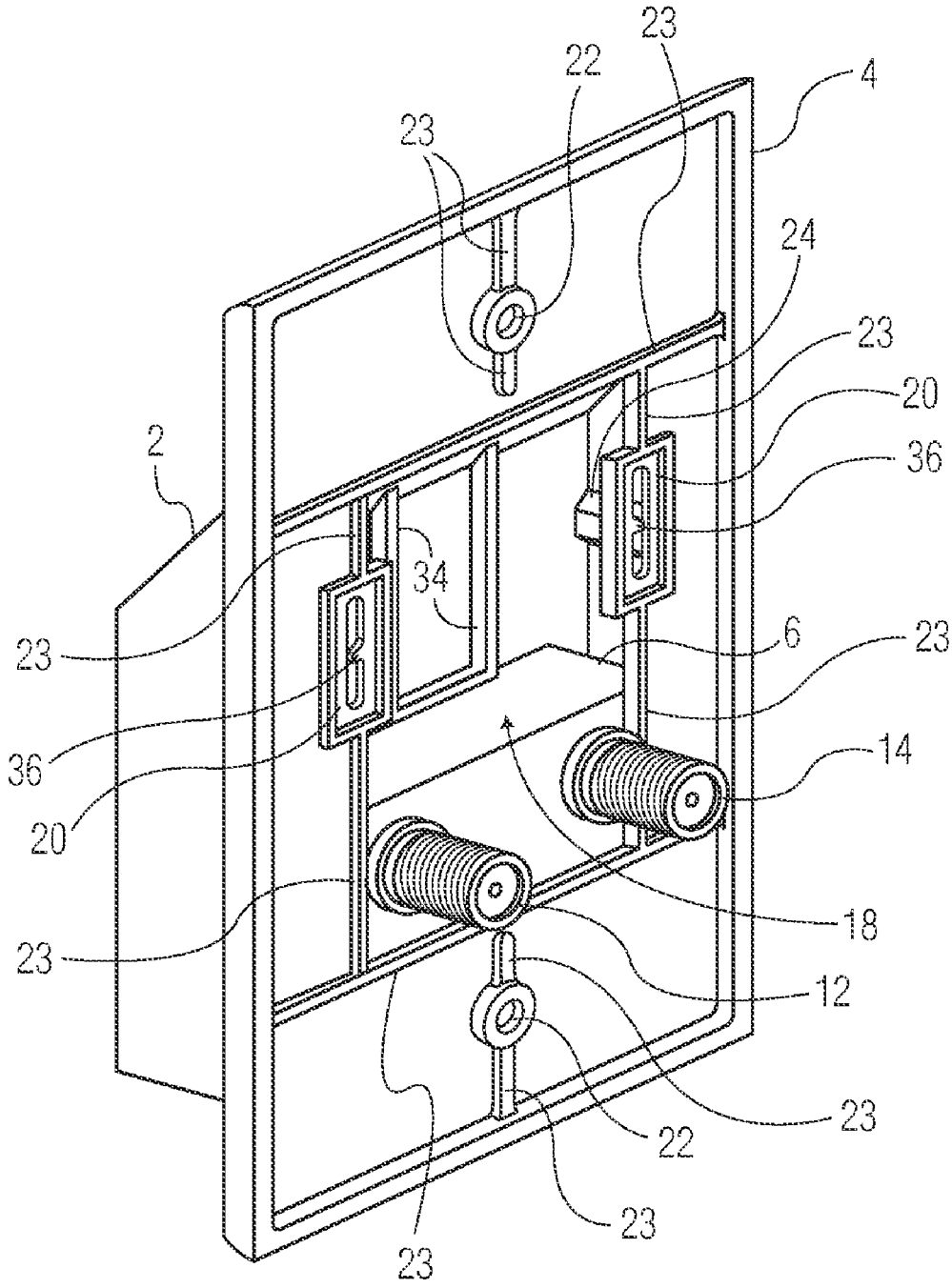
FIG. 8 shows a pictorial view of the back of the faceplate with a cover housing containing a splitter secured to the front of the faceplate.
Figure 9:
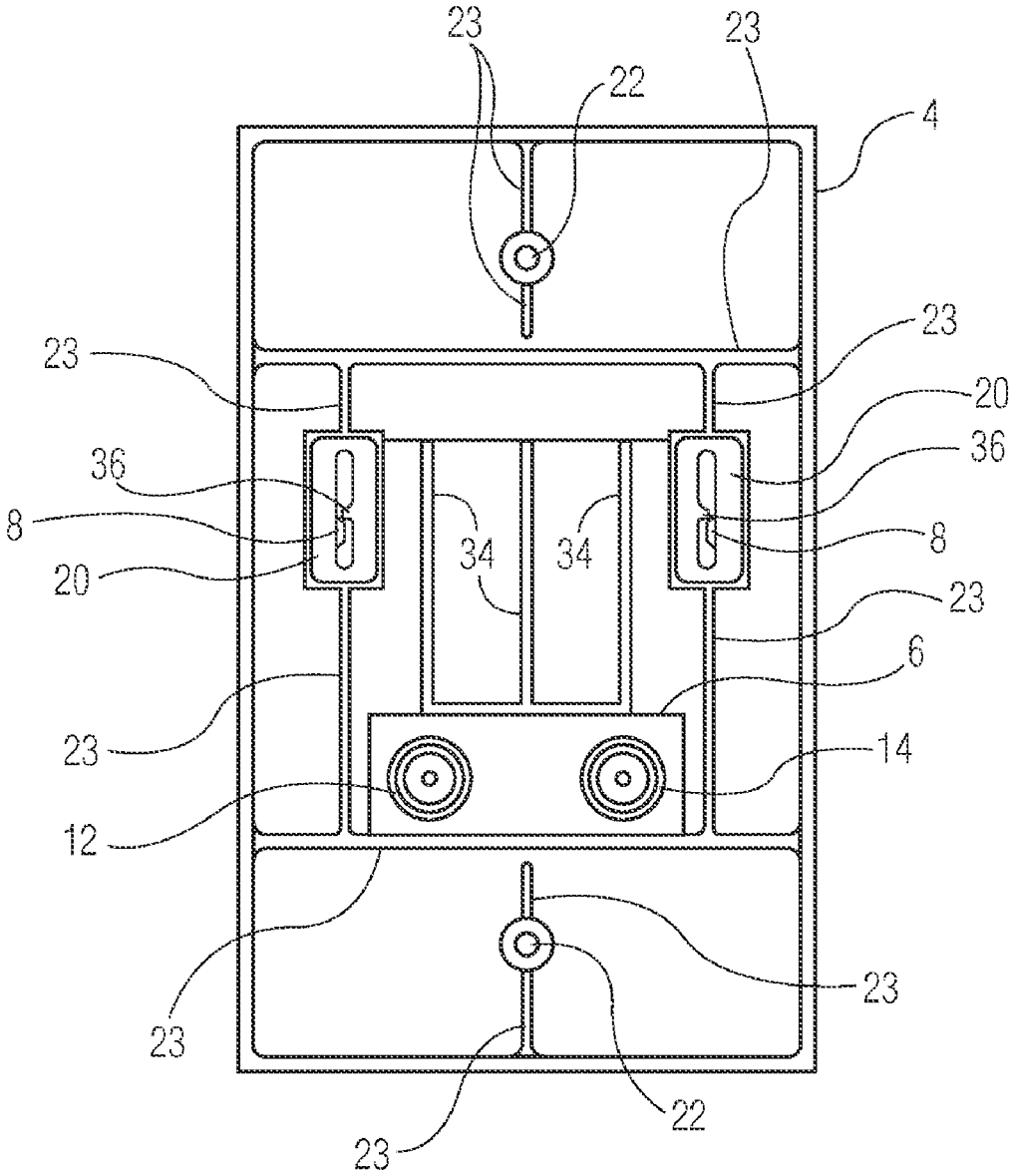
FIG. 9 is a back elevational view of the faceplate with the back of a splitter positioned therein via a cover housing secured to the front of the faceplate.
Figure 10:
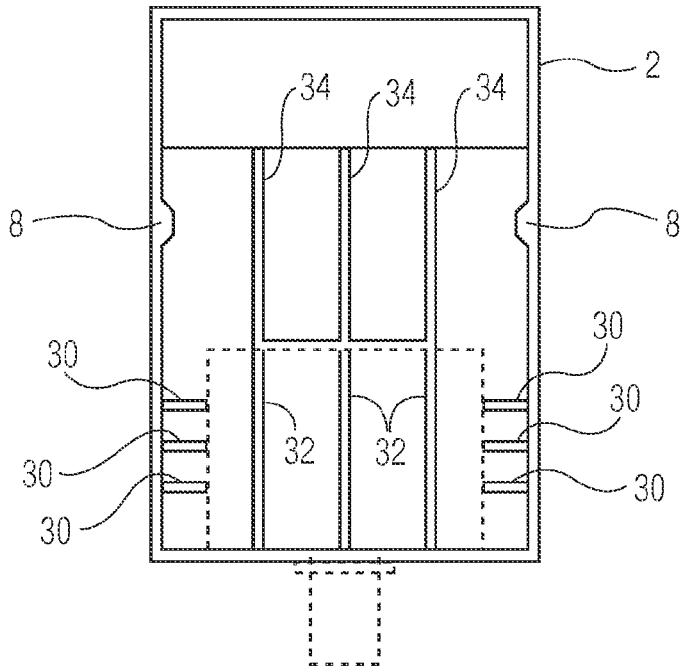
FIG. 10 is a back elevational view of a cover housing for an embodiment of the invention.
Figure 11:
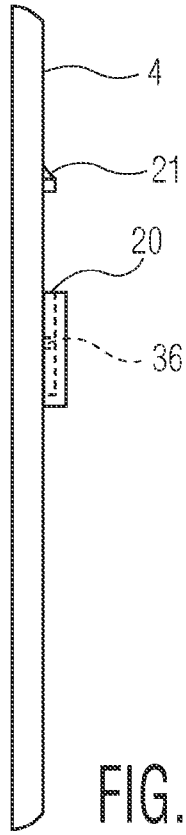
FIG. 11 is a left-side elevational view of a faceplate for an embodiment of the invention, the right side being a mirror image thereof.
Figure 12:
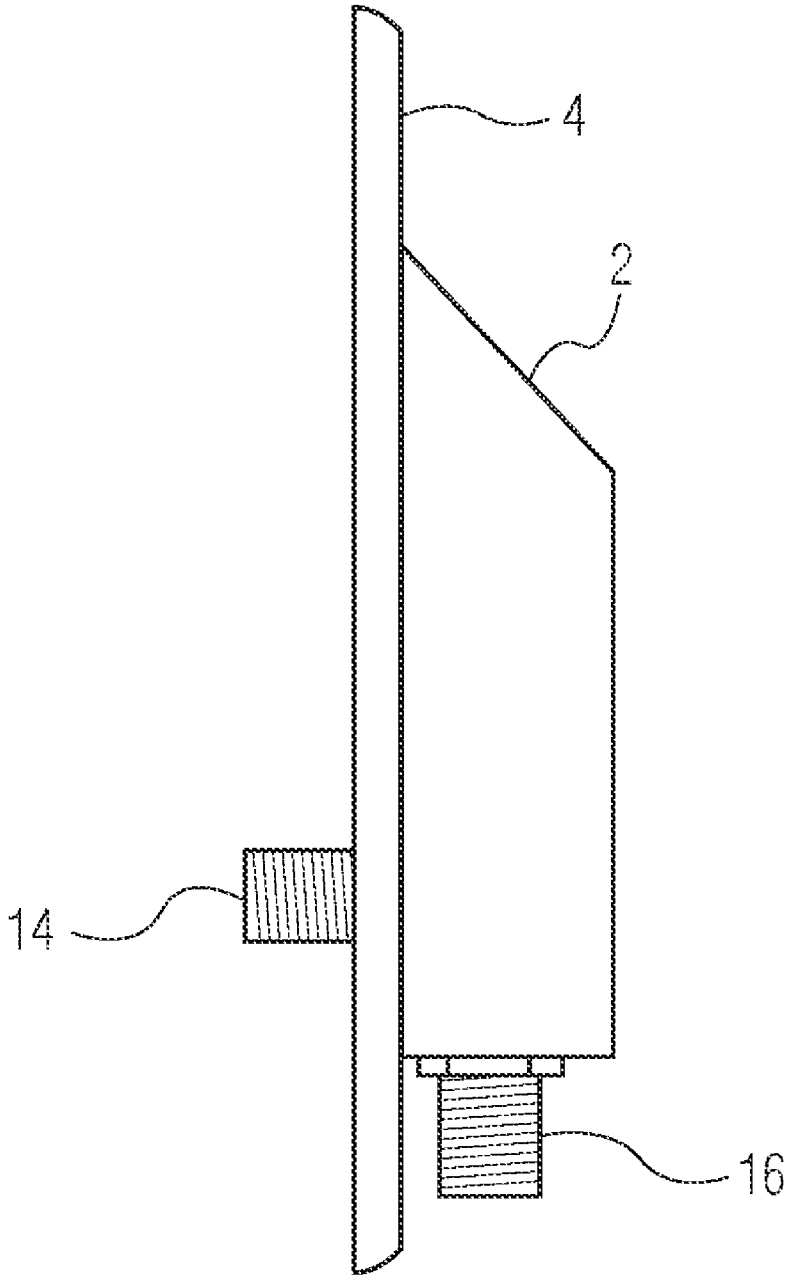
FIG. 12 is a left-side devotional view of a faceplate with a cover housing containing a splitter secured thereto.
Figure 22:
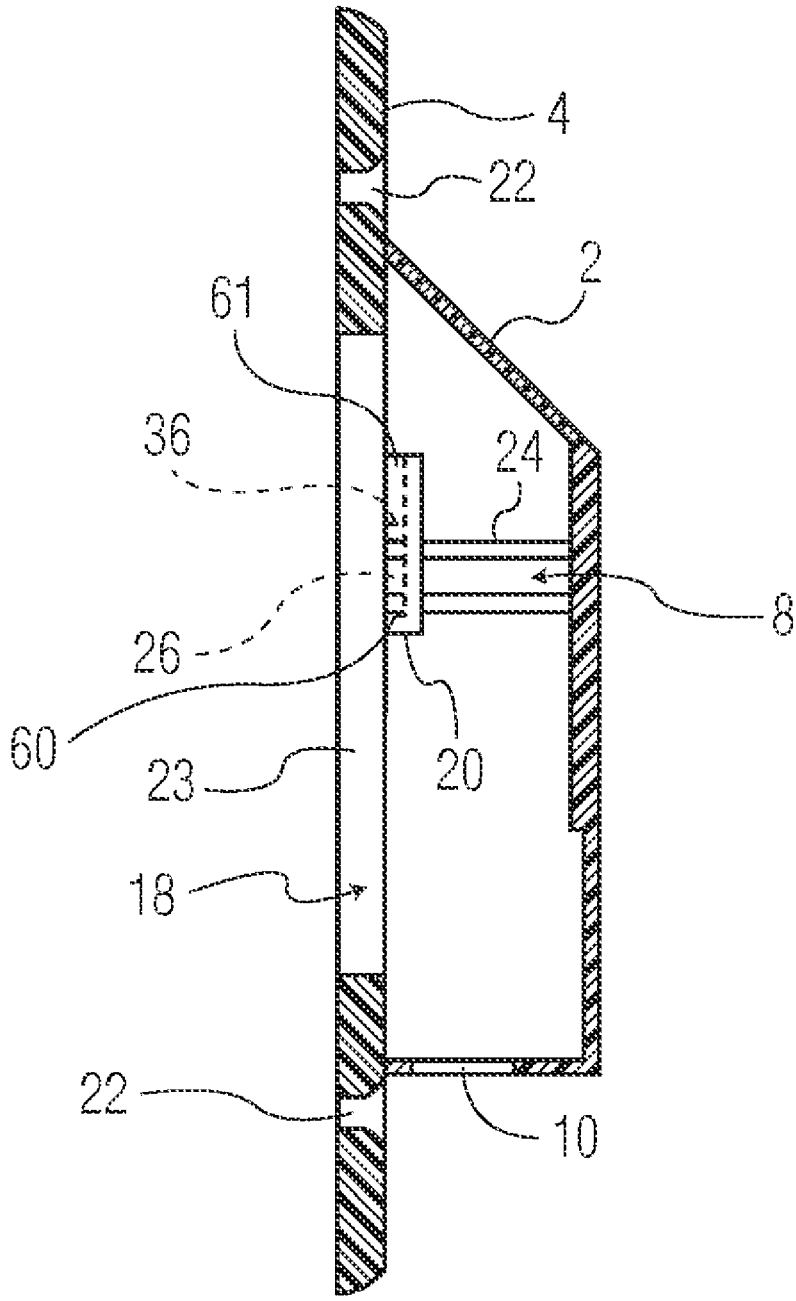
FIG. 22 is a cross-sectional view taken along 14-14 of FIG. 1, with the splitter removed for showing another embodiment of the invention without a stop stud on the faceplate.

FIG. 3 shows an exploded assembly view of faceplate 4, cover housing 2, and splitter 6, respectively. The faceplate 4 (see FIG. 4) includes in this example strengthening ribs 23, and the back portions of the mounting clips 20. As shown in FIGS. 3 and 10, the cover housing 2 includes strengthening ribs 32 and 34, and interior spaced apart triangular standoffs or spacers 30. FIG. 5 shows a detailed pictorial view of the back portion of a mounting dip 20, which is shown also to include tabs 36. Also, FIG. 6 shows a detailed view of the construction of the attachment slot 8. More specifically, attachment slot 8 includes a slotway 28 formed between first protruding member 26, and a second protruding member 24, as shown. FIG. 10 shows a back elevational view of the cover housing 2. FIG. 11 shows a left-side elevational view of faceplate 4. FIG. 13 is a cross-sectional view for showing the installation of cover housing 2 upon faceplate 4 before locking it in place. FIG. 14 is a cross-sectional view showing the completion of the installation of cover housing 2 on faceplate 4, whereby the cover housing 2 has been slid downward upon the outside face of faceplate 4 for causing the opposing attachment slots 8 of cover housing 2 to engage the opposing mounting clips 20, respectively, of faceplate 4, thereby securing the two together. FIG. 7 shows a back pictorial view of covering house 2 with a two-way splitter 6 installed therein. FIGS. 1 and 8 show a cover housing 2 containing a splitter 6, with its cover housing 2 secured to a faceplate 4, viewed from the front and back of faceplate 4, respectively. With reference to FIGS. 6 and 22, cover housing 2 has its downward movement on faceplate 4 limited or stopped by first protruding member 26 of attachment slot 8 striking or contacting the bottom 60 of the channel 61 of mounting clip 20.

Figure 19:
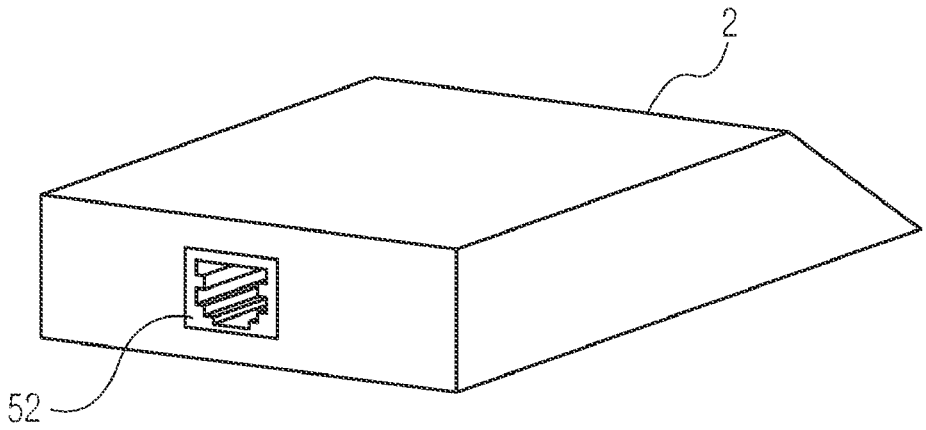
FIG. 19 is a pictorial view of cover housing with a CAT-5 Ethernet cable connector secured to a side portion of the cover housing, for another embodiment of the invention.
Figure 20:
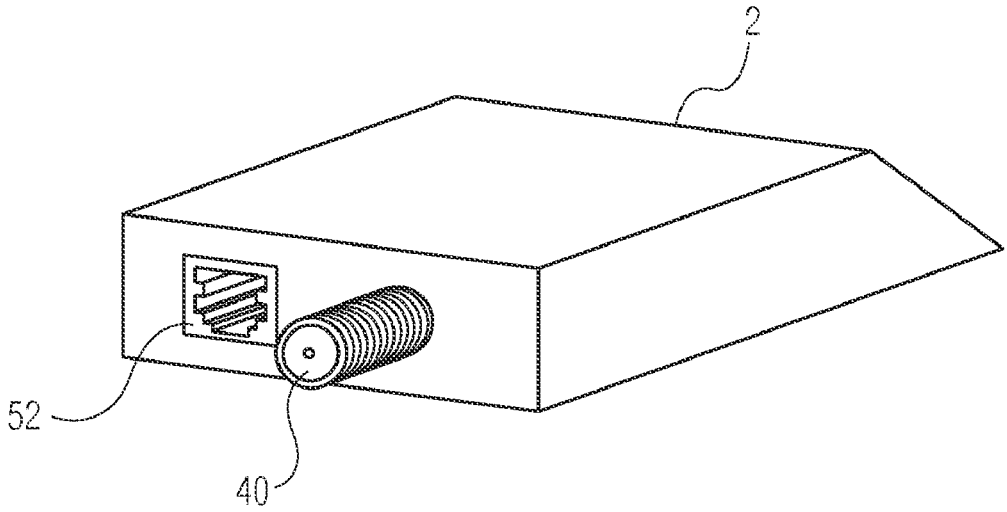
FIG. 20 is a pictorial view looking toward a bottom side portion of the cover housing showing the installation of an Ethernet cable connector, and an F-81 type female coaxial cable connector secured thereto, for another embodiment of the invention.

In another embodiment of the invention, as shown in FIG. 19, the cover housing 2, rather than have a two-way splitter installed therein, is configured to have an Ethernet connector 52 installed into a bottom side portion, as shown, for connection to a "CAT-5 Ethernet" cable (not shown) accessed in the hole 7 of wall 5. FIG. 14 is a pictorial view showing a third embodiment of the invention, whereby the cover housing 2, rather than having a two-way splitter 6 installed therein, is configured to include the Ethernet connector 52, in a spaced apart relation from an F-81 type female coaxial cable connector 40, as shown protruding from a bottom edge portion of cover housing 2, in this example.

Figure 16:
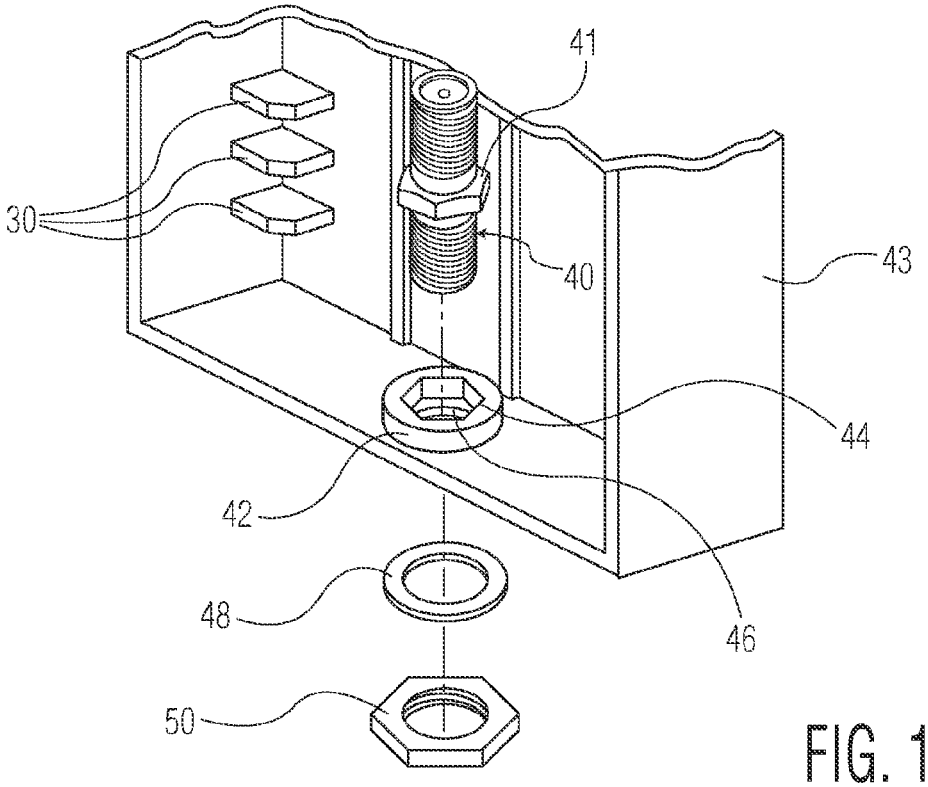
FIG. 16 is an exploded assembly view looking toward the back of cover housing for installing an F-81 connector thereon for another embodiment of the invention.
Figure 17:
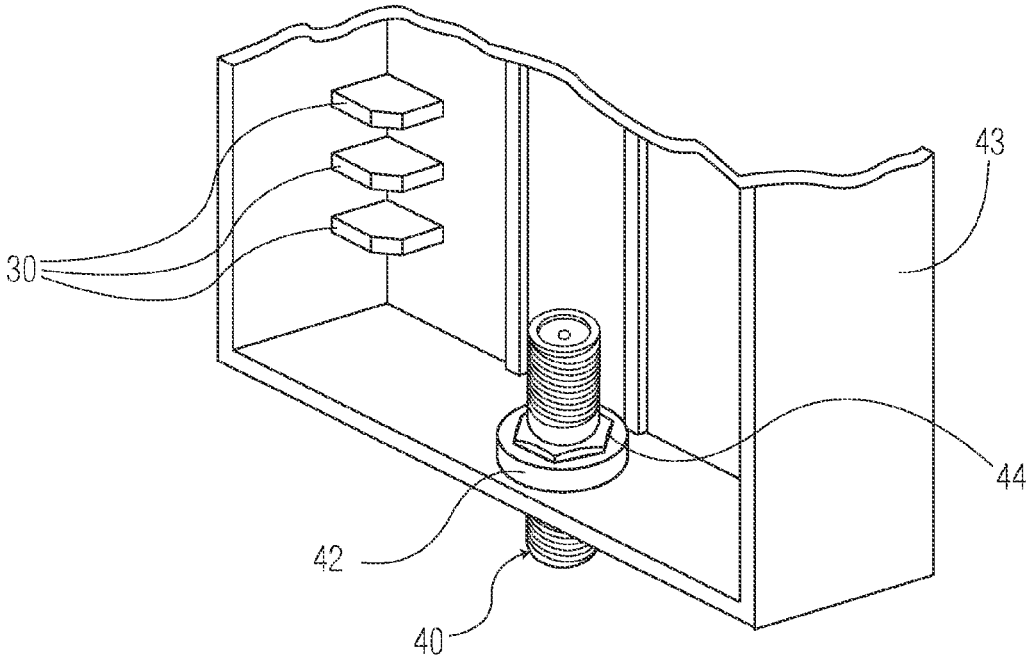
FIG. 17 is a pictorial view of the completed assembly of an F-81 connector in the cover housing.
Figure 18:
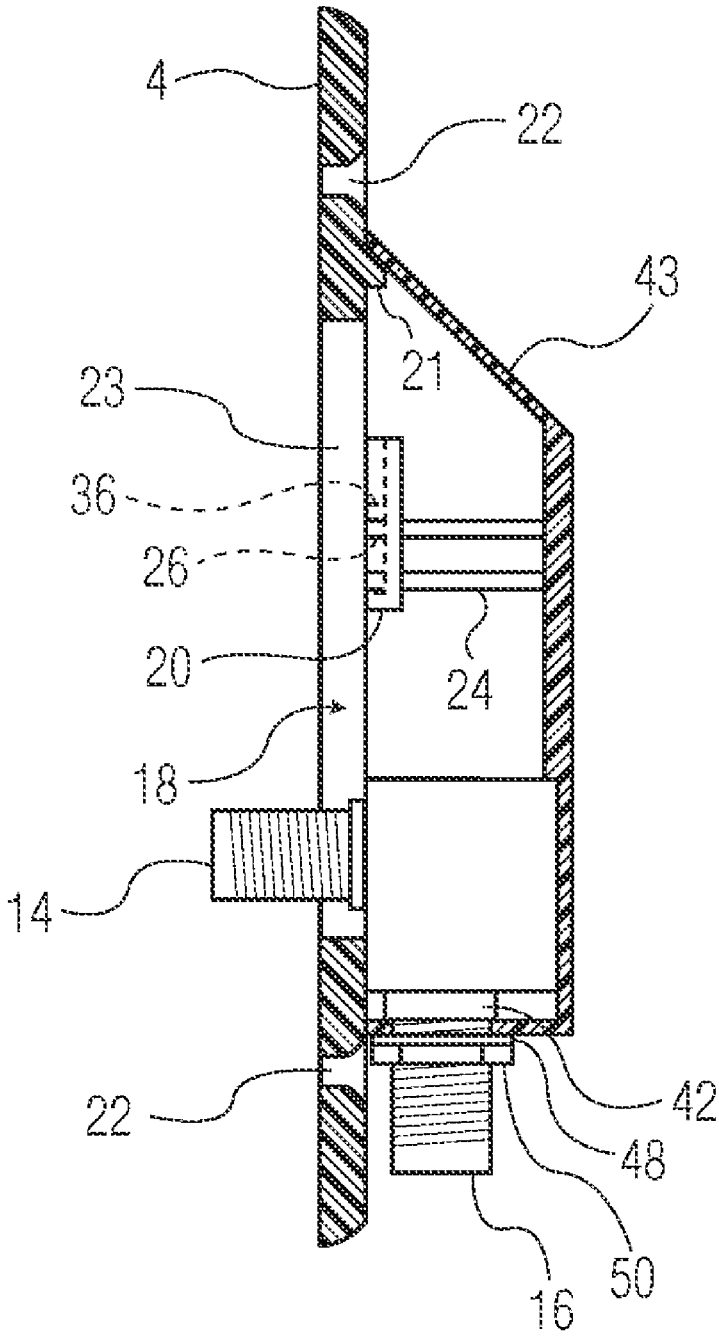
FIG. 18 is a cross-sectional view taken along 13-13 of FIG. 1, but further including the splitter and an added hexagonal boss 42, for another embodiment of the invention.

In a fourth embodiment of the invention, as shown in FIG. 16, a modified cover housing 43 includes on the interior surface of a bottom sidewall 39 protruding boss 42 having a hexagonal shaped opening 44 in association with porthole 46, as shown. Also as shown in the exploded assembly view of FIG. 16, the hexagonal shaped portion 44 of boss 42 is for receiving the hexagonal shaped portion 41 of an F-81 connector to permit it to be secured to the cover housing 2 via a washer 48 and nut 50, as shown. The boss 42 with the hexagonal shaped portion 44 ensures that the F-81 connector 41 will not turn or spin around when being secured to cover housing 2 via nut 50. Note that this boss 42 can be included for securing a user output port 16 of a splitter 6 of cover housing 2, as previously described for other embodiments of the invention. FIG. 18 shows a splitter 6 secured within a cover housing 43 that includes a boss 42. Note that the modified cover housing 43 shown FIG. 16 is otherwise substantially the same as cover housing 2 as previously described.

Figure 23:
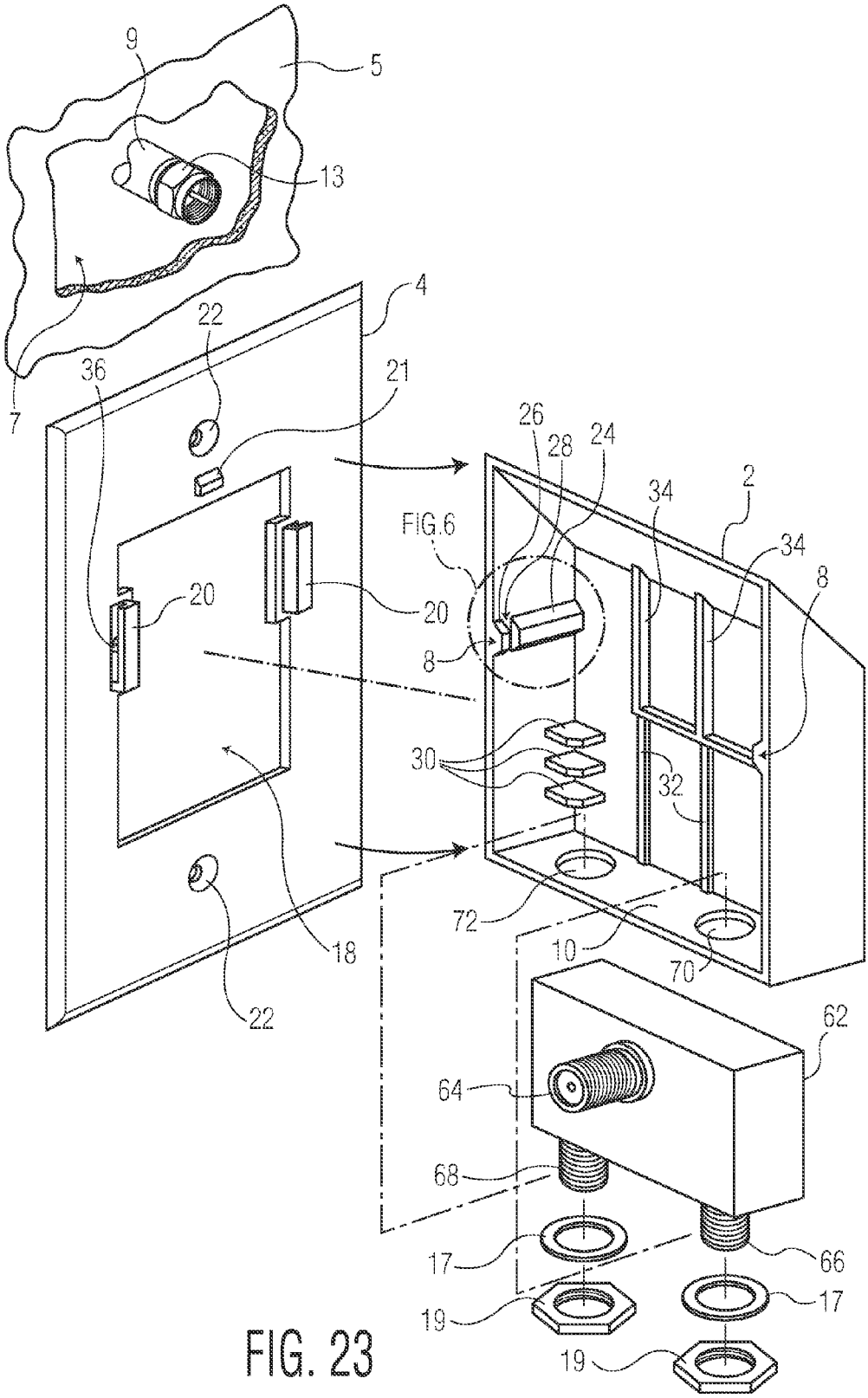
FIG. 23 is an exploded assembly view for another embodiment of the invention.

In another embodiment of the invention as shown in FIG. 23, the cover housing 2 is modified to include two port holes 70 and 72 as shown for receiving output ports 66 and 68, respectively, of a splitter 62, which are each secured thereto via a washer 17 and nut 19, as shown in this example. Splitter 62 includes an input port 64 for connection to feed-in coaxial cable 9 via connector 13.

Although various embodiments of the invention have been shown and described, they are not meant to be limiting. For example, the cover housing 2 can be configured to secure therein other electrical connectors than those mentioned above, and other electrical or electronic devices than a two-way splitter 6, for use in different applications. Those of skill in the art may recognize various modifications to these embodiments, which modifications are meant to be covered by the spirit and scope of the appended claims.

What is claimed is:

1. An apparatus for aesthetically covering an opening or hole in a wall providing access to at least one signal cable located in the wall opening, said apparatus comprising:

a faceplate having front and back portions, said faceplate being configured for securement to the wall over the wall opening, the front portion of said faceplate facing outward from said wall, said faceplate including:

an opening to provide access to at least one signal cable in the wall opening;

a pair of vertically oriented mounting clips on opposing sides of the front portion of said faceplate opening; and a pair of vertically oriented centrally located screw holes proximate the top and bottom edges of the front portion of said faceplate; and a cover housing configured to have a cavity for mounting therein at least one electrical device, said device including first means for electrical connection to an end of said at least one signal cable, and having second means secured through a hole in a side portion of said cover housing, said second means being configured for attachment to mating means on an end of a user signal cable coupled at its other end to a user's apparatus operable for receiving signals provided by said at least one signal cable, said cover housing further including:

a pair of attachment slots centrally located on opposing interior vertically oriented outer side edges about the entry into said cavity, said attachment slots being configured for providing secure ent to the mounting dips of said faceplate, to permit selective attachment or removal of said cover housing to or from said faceplate.

2. The apparatus of claim 1, said faceplate further including stop means for limiting downward movement of said cover housing during attachment upon said faceplate.

3. The apparatus of claim 2, wherein said stop means includes a stud protruding from the first portion of said faceplate proximate a top portion of said access opening.

4. The apparatus of claim 1, wherein said pair of mounting clips of said faceplate each include retention means for securing said pair of attachment slots of said cover housing therein, respectively.

5. The apparatus of claim 1, further including:

stop means for limiting downward movement of said cover housing during attachment upon said faceplate; and retention mans for removably securing said pair of attachment slots of said cover housing within said pair of mounting clips of said faceplate.

6. The apparatus of claim 5, further including:

said stop means including a stud protruding from the front portion of said faceplate proximate a top portion of said access opening; and said retention means includes a tab protruding into a portion of a channel formed in each of said pair of mounting dips.

7. The apparatus of claim 4, wherein said retention means includes a tab protruding into a portion of a channel formed in each one of said pair of mounting clips.

8. The apparatus of claim 1, wherein the side portion of said cover housing including said hole, further includes antirotation means surrounding said hole configured for securing an F-81 connector therein to prevent it from rotating about said hole when installed in said cover housing.

9. The apparatus of claim 8, wherein said antirotation means includes a hexagonal recess surrounding said hole on an inside surface of said side portion of said housing for retaining therein a hexagonal nut portion of said F-81 connector.

10. The apparatus of claim 1, wherein said electrical device is an Ethernet connector.

11. The apparatus of claim 1, wherein said electrical device is an F-81 connector.

12. The apparatus of claim 1, further including:

said electrical device consisting of a splitter including an input port for receiving RF signals, a first output port for outputting a first portion of the received RF signals, and a second output port for outputting a second portion of the received RF signals;

said second output port protruding from the hole in the side portion of said cover housing, and being secured thereto, for connection to said user signal cable;

a first RF signal cable within said wall opening for connection to said input port of said splitter, for feeding RF signals thereto;

a second RF signal cable within said wall opening for connection to said first output port for returning RF signals therefrom.

13. The apparatus of claim 1, further including:

first and second holes in side portions of said cover housing;

an Ethernet connector located within and secured to said first hole providing user assess thereto;

an F-81 type coaxial cable connector located within and secured to said second hole providing user access thereto;

an Ethernet cable being located in said wall opening for connection to said Ethernet connector; and a coaxial cable being located in said wall opening for connection to said F-81 type coaxial cable connector.

14. The apparatus of claim 13, wherein said Ethernet cable consists of a CAT-5 Ethernet cable.

15. The apparatus of claim 1, wherein said faceplate, and said cover housing each are formed from plastic material.

16. The apparatus of claim 1, wherein said pair of mounting clips each include:

an elongated channel formed in a U-shaped protrusion from the front portion of said faceplate, the channel being open at its top end, closed at its bottom end, and opening away from an associated side of said faceplate opening.

17. The apparatus of claim 1, wherein said pair of attachment slots each include:

a first tab protruding inward into and from an interior outer side edge portion of the cavity of said cover housing; and a second tab protruding inward into and from said interior side portion of said cavity, said second tab being spaced away from and opposing said first tab thereby forming an attachment slot therebetween.

18. The apparatus of claim 16, further including a tab protruding into a portion of said channel, said tab being configured for removably securing an associated attachment slot within said channel.

19. The apparatus of claim 1, further including:

said pair of mounting cups each including an elongated channel formed in a U-shaped protrusion from the front portion of said faceplate, the channel being open at its top end, closed at its bottom end, and opening away from said faceplate opening associated side;

said pair of attachment slots each including a first tab protruding inward into and from an interior outer side edge portion of the cavity of said cover housing; and a second tab protruding inward into and from said interior side portion of said cavity, said second tab being spaced away from and opposing said first tab thereby forming an attachment slot therebetween.

20. The apparatus of claim 19, further including a tab protruding into a portion of said channel of each one of said pair of mounting clips, said tab being configured for removable securing an associated attachment slot.

21. The apparatus of claim 19, further including stop means for limiting downward movement of said cover housing during attachment upon said faceplate, said stop means being provided by said first tabs striking or bottoming out at the associated bottom ends of their associated channels.

22. An apparatus for aesthetically covering an opening or hole in a wall providing access to at least one signal cable located in the wall opening, said apparatus comprising:

a faceplate having front and back portions, said faceplate being configured for securement to the wall over the wall opening, the front portion of said faceplate facing outward from said wall, said faceplate including:

an opening to provide access to at least one signal cable in the wall opening;

a pair of vertically oriented mounting clips on opposing sides of the front portion of said faceplate opening; and a pair of vertically oriented centrally located screw holes proximate the top and bottom edges of the front portion of said faceplate; and a cover housing configured to have a cavity for mounting therein at least one electrical device, said device including first means for electrical connection to an end of said at least one signal cable, and having second and third means secured through first and second holes, respectively, in a side portion of said cover housing, said second and third means being configured for attachment to the ends of first and second user signal cables, respectively, said cover housing further including:

a pair of attachment slots centrally located on opposing interior vertically oriented outer side edges about the entry into said cavity, said attachment slots being configured for providing securement to the mounting clips of said faceplate, to permit selective attachment or removal of said cover housing to or from said faceplate.

23. The apparatus of claim 22, further including:

said electrical device consisting of a splitter including an input port for receiving RF signals, a first output port for outputting a first portion of the received RF signals, and a second output port for outputting a second portion of the received RF signals;

said first and second output ports protruding from said first and second holes in the side portion of said cover housing, and being secured thereto, for connection to the ends of said first and second user signal cables, respectively; and an RF signal cable within said wall opening for connection to said input port of said splitter, for feeding RF signals thereto.

* * * * *